US008444142B2

(12) United States Patent
Fujii et al.

(10) Patent No.: US 8,444,142 B2
(45) Date of Patent: May 21, 2013

(54) MULTIFEED PROCESSING APPARATUS, MULTIFEED PROCESSING METHOD, AND MULTIFEED PROCESSING PROGRAM

(75) Inventors: Yoshihiro Fujii, Ishikawa (JP); Shinji Suzuki, Ishikawa (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 13/043,991

(22) Filed: Mar. 9, 2011

(65) Prior Publication Data

US 2011/0278791 A1 Nov. 17, 2011

(30) Foreign Application Priority Data

May 14, 2010 (JP) ..... 2010-112447

(51) Int. Cl.
*B65H 7/02* (2006.01)

(52) U.S. Cl.
USPC ..... 271/258.01; 700/228; 358/498; 382/199

(58) Field of Classification Search
USPC 271/258.01, 259, 262, 263, 265.04; 700/228; 358/498; 382/100, 112, 199
See application file for complete search history.

(56) References Cited

U.S. PATENT DOCUMENTS

| | | | | |
|---|---|---|---|---|
| 7,446,278 | B2 * | 11/2008 | Fesquet et al. | 209/584 |
| 7,654,521 | B2 * | 2/2010 | Simonis et al. | 271/262 |
| 7,809,158 | B2 * | 10/2010 | Carpenter et al. | 382/101 |
| 8,272,639 | B2 * | 9/2012 | Simonis et al. | 271/262 |
| 2005/0228535 | A1 * | 10/2005 | Simonis et al. | 700/228 |
| 2006/0145412 | A1 | 7/2006 | Tagawa et al. | |
| 2009/0087014 | A1 * | 4/2009 | Goodwin et al. | 382/100 |
| 2011/0081051 | A1 * | 4/2011 | Tayal et al. | 382/112 |

FOREIGN PATENT DOCUMENTS

JP 2004-269241 9/2004

OTHER PUBLICATIONS

Canon Inc. User Manual (functional detail) of scanner "DR-X10C" <URL: http://cweb.canon,jp/manual/dr/pdf/drx10c-usermanual2.pdf>.

* cited by examiner

*Primary Examiner* — Jeremy R Severson
(74) *Attorney, Agent, or Firm* — McDermott Will & Emery LLP

(57) ABSTRACT

A multifeed processing apparatus includes a control unit and is connected to a multifeed detecting mechanism and an image reading mechanism. The control unit includes (i) a calculating unit that calculates a shape of a peripheral edge of a medium from any one or both of an output of the image reading mechanism and an image of the medium read by the image reading mechanism, (ii) a detecting unit that detects a change in the shape on a boundary of an overlap detected portion, from the shape calculated by the calculating unit and a position of the overlap detected portion detected by the multifeed detecting mechanism, and (iii) a deciding unit that determines a case where the change in the shape is detected by the detecting unit, as a multifeed.

9 Claims, 9 Drawing Sheets

MULTIFEED PROCESSING APPARATUS, MULTIFEED PROCESSING METHOD, AND MULTIFEED PROCESSING PROGRAM

CROSS-REFERENCE TO RELATED APPLICATION

This application is based upon and claims the benefit of priority from Japanese Patent Application No. 2010-112447, filed on May 14, 2010, the entire contents of which are incorporated herein by reference.

BACKGROUND OF THE INVENTION

1. Field of the Invention

The present invention relates to a multifeed processing apparatus, a multifeed processing method, and a multifeed processing program for processing a result of multifeed detection performed by a multifeed detecting function of an image reading apparatus (e.g., a scanner, a copier, and a facsimile).

2. Description of the Related Art

In an image reading apparatus (image scanner apparatus), there is widely used a multifeed detecting function using an ultrasonic sensor that can detect paper overlapping (e.g., Japanese Patent Application Laid-open No. 2004-269241). However, there is a case where the multifeed detecting function erroneously detects a paper with attached photo and sticky note or the like as a multifeed.

As means for avoiding this case, United States Patent Application No. 2005/0228535 discloses a technology for previously setting a length with which multifeed detection is disabled through a panel on a scanner before reading is started, and user manual (functional detail) of scanner "DR-X10C" released in home page of canon inc. "http://cweb-.canon.jp/manual/dr/pdf/drx10c-usermanual2.pdf" discloses a technology for previously setting a starting position and an ending position at which multifeed detection is disabled through a screen on a personal computer connected to a scanner before reading is started.

However, according to the conventional technologies, there is a problem that the length and the position to be disabled have to be previously set and the setting needs to be changed depending on a paper to be read, this causes a user to carry out troublesome operations for the setting and the changing. There is also a problem that when papers are actually multiply fed and if the state of the multifeed coincides with preset disabling conditions, the multifeed cannot be detected.

SUMMARY OF THE INVENTION

It is an object of the present invention to at least partially solve the problems in the conventional technology.

A multifeed processing apparatus according to one aspect of the present invention includes a control unit. The multifeed processing apparatus is connected to a multifeed detecting mechanism and an image reading mechanism. The control unit includes (i) a calculating unit that calculates a shape of a peripheral edge of a medium from any one or both of an output of the image reading mechanism and an image of the medium read by the image reading mechanism, (ii) a detecting unit that detects a change in the shape on a boundary of an overlap detected portion, from the shape calculated by the calculating unit and a position of the overlap detected portion detected by the multifeed detecting mechanism, and (iii) a deciding unit that determines a case where the change in the shape is detected by the detecting unit, as a multifeed.

A multifeed processing method according to one aspect of the present invention is implemented by a control unit of a multifeed processing apparatus that includes the control unit and is connected to a multifeed detecting mechanism and an image reading mechanism. The multifeed processing method includes (i) a calculating step of calculating a shape of a peripheral edge of a medium from any one or both of an output of the image reading mechanism and an image of the medium read by the image reading mechanism, (ii) a detecting step of detecting a change in the shape on a boundary of an overlap detected portion, from the shape calculated at the calculating step and a position of the overlap detected portion detected by the multifeed detecting mechanism, and (iii) a deciding step of determining a case where the change in the shape is detected at the detecting step, as a multifeed.

A multifeed processing program product according to one aspect of the present invention makes a control unit of a multifeed processing apparatus that includes the control unit and is connected to a multifeed detecting mechanism and an image reading mechanism implement a multifeed processing method. The multifeed processing method includes (i) a calculating step of calculating a shape of a peripheral edge of a medium from any one or both of an output of the image reading mechanism and an image of the medium read by the image reading mechanism, (ii) a detecting step of detecting a change in the shape on a boundary of an overlap detected portion, from the shape calculated at the calculating step and a position of the overlap detected portion detected by the multifeed detecting mechanism, and (iii) a deciding step of determining a case where the change in the shape is detected at the detecting step, as a multifeed.

A recording medium according to one aspect of the present invention includes the multifeed processing program product described above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of a multifeed processing apparatus, a multifeed processing method, and a multifeed processing program according to the present invention will be explained in detail below with reference to the accompanying drawings. It should be noted that the present invention is not limited by the embodiments. Particularly, in the embodiments, a case where the multifeed processing apparatus is implemented (incorporated) in an image reading apparatus will be explained as one example, however, the multifeed processing apparatus may be implemented in an information processing apparatus (personal computer) communicably connected to the image reading apparatus.

1. Overview of Present Embodiment

Here, the overview of the present embodiment will be explained in detail with reference to FIGS. 1A and 1B to FIG. 6.

Conventionally, as multifeed detection using an ultrasonic sensor in the image reading apparatus, there is known a method for previously setting a size (length) and an area (position, length) by which a multifeed is disabled and ignoring the multifeed detected within the set range.

However, in this method, there are following problems: (1) to (3).

(1) It is necessary to previously specify a size and an area in some way.

(2) It is necessary to change a setting depending on a paper to be read, and thus the operation is troublesome.

Figure 1A:
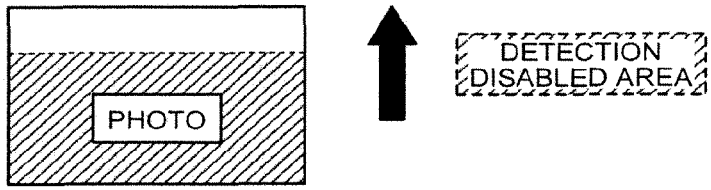
FIG.1A Related Art
FIGS. 1A and 1B are diagrams representing one examples of a conventional technology.
Figure 1B:
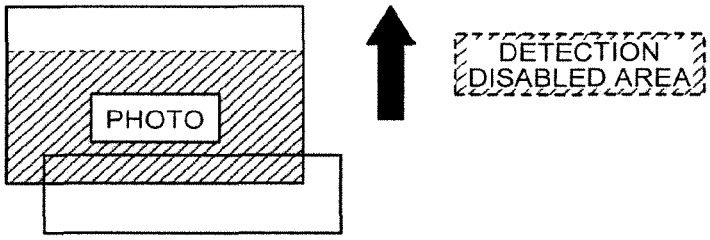
FIG.1B Related Art

(3) A condition to disable a multifeed (detection disabled area) is previously set as shown in FIG. 1A, and when papers are actually multiply fed and if a state of the multifeed coincides with the condition as shown in FIG. 1B, the multifeed cannot be detected.

Figure 2:
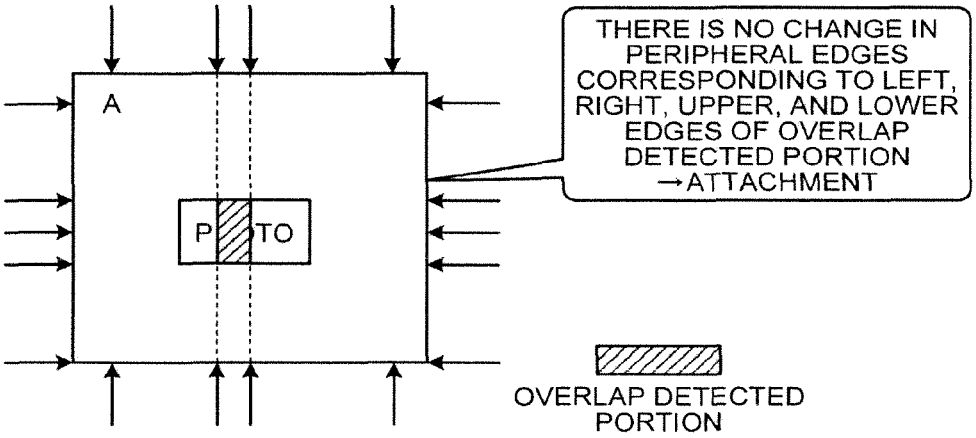
FIG. 2 is a schematic representing one example of a case that is determined as "attachment" by a solution 1 of a present embodiment.
Figure 3:
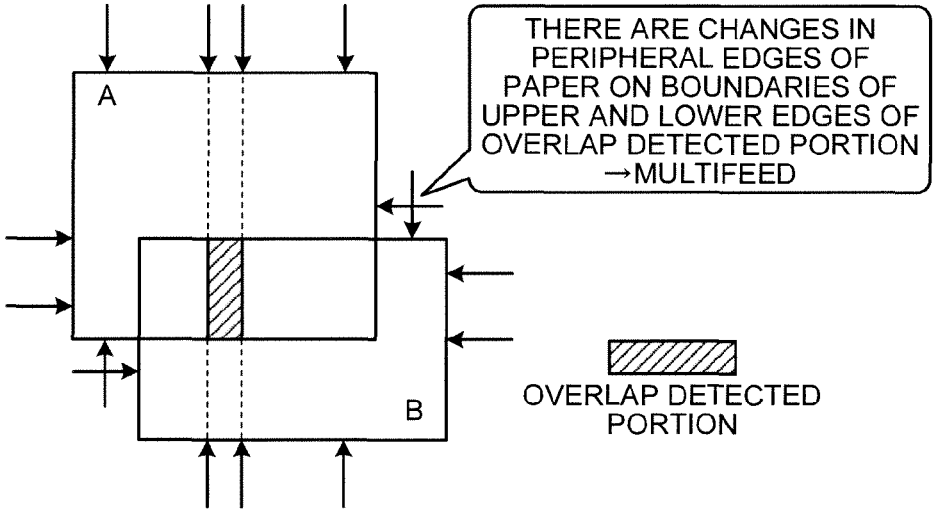
FIG. 3 is a schematic representing one example of a case that is determined as "multifeed" by the solution 1 of the present embodiment.

Therefore, the present embodiment is configured to detect whether a shape of a peripheral edge of a paper changes on a boundary of an overlap detected portion, from left, right, upper, or lower edge of the overlap detected portion detected by the ultrasonic sensor and from the shape of an overall paper which can be obtained from a paper sensor and image information or the like, and to determine a case where the shape of the peripheral edge of the paper change, as "multifeed" (Solution 1). Specifically, as shown in FIG. 2, when the shapes of the peripheral edges of the paper situated along the left, right, upper, and lower edges of the overlap detected portion do not change, this case is determined as "attachment" of a photo, a slip, or the like. As shown in FIG. 3, when the shapes of the peripheral edges of the paper change on the boundaries of the upper and lower edges of the overlap detected portion, this case is determined as "multifeed". This enables a multifeed to be detected with a considerably high probability. It should be noted that determination is not made only by a single change in the shape of the peripheral edge, but by combining a plurality of positions where the shapes of the peripheral edges change, it can also be determined whether a sticky note is attached to the paper.

Figure 4:
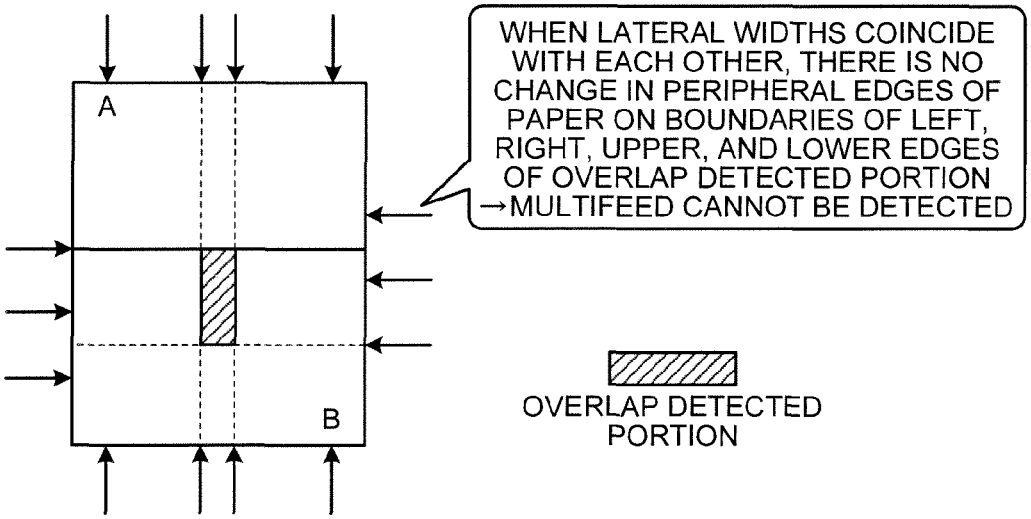
FIG. 4 is a schematic representing one example of a case that is not determined as "multifeed" by the solution 1 of the present embodiment.

However, as shown in FIG. 4, if a paper A and a paper B are multiply fed in a state in which their paper widths coincide with each other (left and right positions of the widths coincide with each other), this case cannot be determined as "multifeed" by the solution 1 because the shapes of the peripheral edges of the paper do not change on the boundaries of the left, right, upper, and lower edges of the overlap detected portion.

Therefore, when the shapes of the peripheral edges of the paper along the left, right, upper, and lower edges of the overlap detected portion do not change and thus this case is determined as "attachment" of a photo, a slip, or the like in the solution 1, the present embodiment is configured to further analyze images of a detection starting position and a detection ending position of the overlap detected portion, detect an overlap range from continuity of the images, and determine a case, where the overlap range continues up to an outside of the paper, as "multifeed" (Solution 2). This enables the multifeed to be accurately detected even if the paper width of the paper A and that of the paper B coincide with each other (left and right positions of the widths coincide with each other). It should be noted that multifeed detection with higher accuracy can also be performed by combining results of determinations (detections) of respective front and rear surfaces of the paper.

Figure 5:
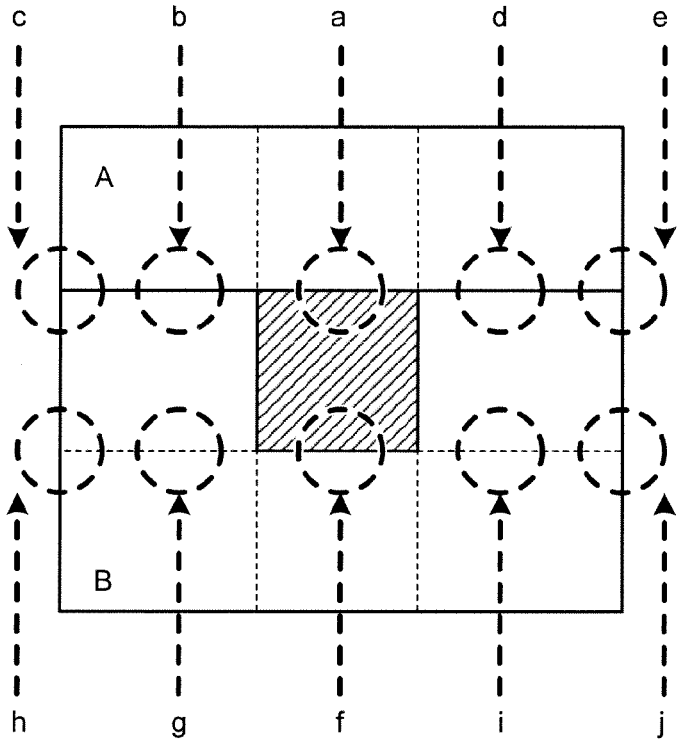
FIG. 5 is a schematic representing one example of a case that is determined as "multifeed" by a solution 2 of the present embodiment.
Figure 6:
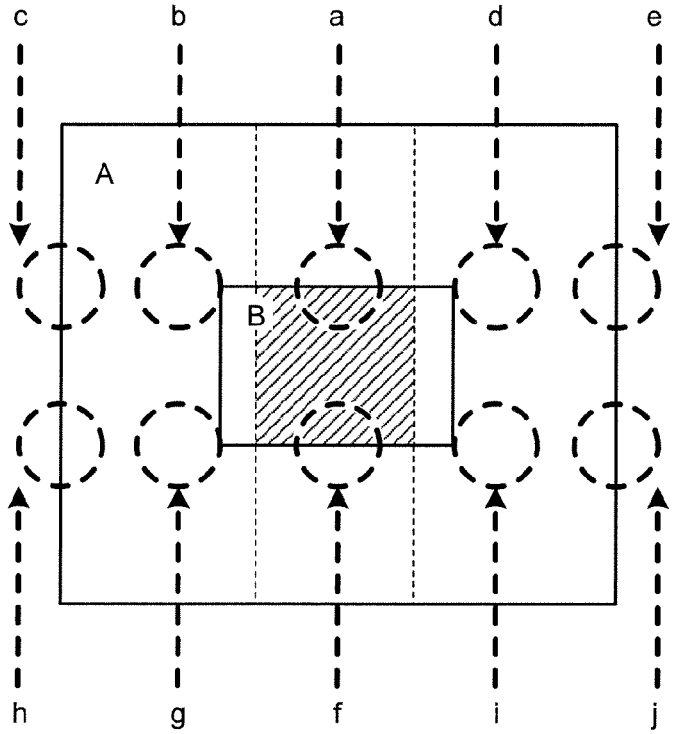
FIG. 6 is a schematic representing one example of a case that is determined as "attachment" by the solution 2 of the present embodiment.

Specifically, as shown in FIG. 5 which is one example of the case that is determined as "multifeed", and as shown in FIG. 6 which is one example of the case that is determined as "attachment" of a photo, a slip, or the like, first, an image change on upper edge boundaries of the paper A and the paper B are extracted from an image a of the upper edge of the overlap detected portion by detecting a change in color due to different types of papers and by detecting a shade of the paper B overlapped on the paper A. In both the example of FIG. 5 and the example of FIG. 6, an image change is generally extracted from the image a.

Next, images b and c in the left direction (which is determined by taking into consideration a skew of the paper previously calculated from the sensor or the like) of the image a are sequentially read, and by extracting whether there is any image change similar to the image a from the images b and c, it is detected whether the image change similar to the image a continues up to the left-side peripheral edge of the paper. In the example of FIG. 5, the image change similar to the image a can be extracted from the images b and c, so that it is detected that the image change similar to the image a continues up to the left-side peripheral edge of the paper. In the example of FIG. 6, the image change similar to the image a cannot be extracted from the images b and c, so that it is detected that the image change similar to the image a does not continue up to the left-side peripheral edge of the paper.

Next, for images d and e in the right direction of the image a, by extracting whether there is any image change similar to the image a in the above manner, it is detected whether the image change similar to the image a continues up to the right-side peripheral edge of the paper. In the example of FIG. 5, the image change similar to the image a can be extracted from the images d and e, so that it is detected that the image change similar to the image a continues up to the right-side peripheral edge of the paper. In the example of FIG. 6, the image change similar to the image a cannot be extracted from the images d and e, so that it is detected that the image change similar to the image a does not continue up to the right-side peripheral edge of the paper.

Next, an image change on lower edge boundaries of the paper A and the paper B is extracted in the above manner from an image f of the lower edge of the overlap portion. In the example of FIG. 5, because a cut line of the paper A is present on the rear surface (rear side) of the paper B, the image change cannot be extracted from the image f. Meanwhile, in the example of FIG. 6, because the paper B is present so as to fit on the paper A, the image change is extracted from the image f.

Next, for images g and h in the left direction of the image f and images i and j in the right direction of the image f, by extracting whether there is any image change similar to the image f in the above manner, it is detected whether the image change similar to the image f continues up to the left-side peripheral edge and the right-side peripheral edge of the paper, respectively. In the example of FIG. 5, the image change similar to the image f (or there is no image change) can be extracted from the images g, h, i, and j respectively, so that it is detected that the image change similar to the image f continues up to the left-side peripheral edge and the right-side peripheral edge of the paper. In the example of FIG. 6, the image change similar to the image f (or there is an image change) cannot be extracted from the images g, h, i, and j respectively, so that it is detected that the image change similar to the image f does not continue up to the left-side peripheral edge and the right-side peripheral edge of the paper, respectively.

Then, in the example of FIG. 5, because the overlap range continues up to some parts of the peripheral edges, this case is determined as "multifeed". Specifically, because there are obtained such results that the image change similar to the image a continues up to the left-side and right-side peripheral edges of the paper and the image change similar to the image f continues up to the left-side and right-side peripheral edges of the paper, this case is determined as "multifeed". In the example of FIG. 6, because the overlap range does not continue up to the peripheral edges of the paper, this case is determined as "attachment" of a photo, a slip, or the like. Specifically, because there are obtained such results that the image change similar to the image a does not continue up to the left-side and right-side peripheral edges of the paper and the image change similar to the image f does not continue up to the left-side and right-side peripheral edges of the paper, this case is determined as "attachment" of a photo, a slip, or the like.

2. Configuration of Present Embodiment

Here, the configuration of an image reading apparatus 100 according to the present embodiment will be explained in detail with reference to FIG. 7 to FIG. 9.

2-1. Overview of Configuration

First, the overview of the configuration of the image reading apparatus 100 according to the present embodiment will be explained with reference to FIG. 7. FIG. 7 is a diagram representing the overview of the configuration of the image reading apparatus according to the present embodiment to which the multifeed processing apparatus according to the present invention is applied.

The image reading apparatus 100 includes a multifeed processing unit 102 corresponding to the multifeed processing apparatus according to the present invention, a multifeed detecting unit (mechanism) 112, and an image reading unit (mechanism) 114 in a functionally conceptual manner, and these units are communicably connected to each other through an arbitrary communication path.

The multifeed detecting unit 112 is a mechanism for detecting a multifeed of a fed paper, and includes, for example, an ultrasonic sensor (hardware) for detecting overlap of papers and the thickness thereof using ultrasonic waves, and a processing unit (software) for detecting whether a multifeed occurs from the output of the ultrasonic sensor. A specific example of the configuration of the multifeed detecting unit 112 will be explained in detail later in "2-2. Specific Example of Configuration". The image reading unit 114 is a mechanism for reading a fed paper by a paper sensor and generating an image of the paper.

Figure 7:
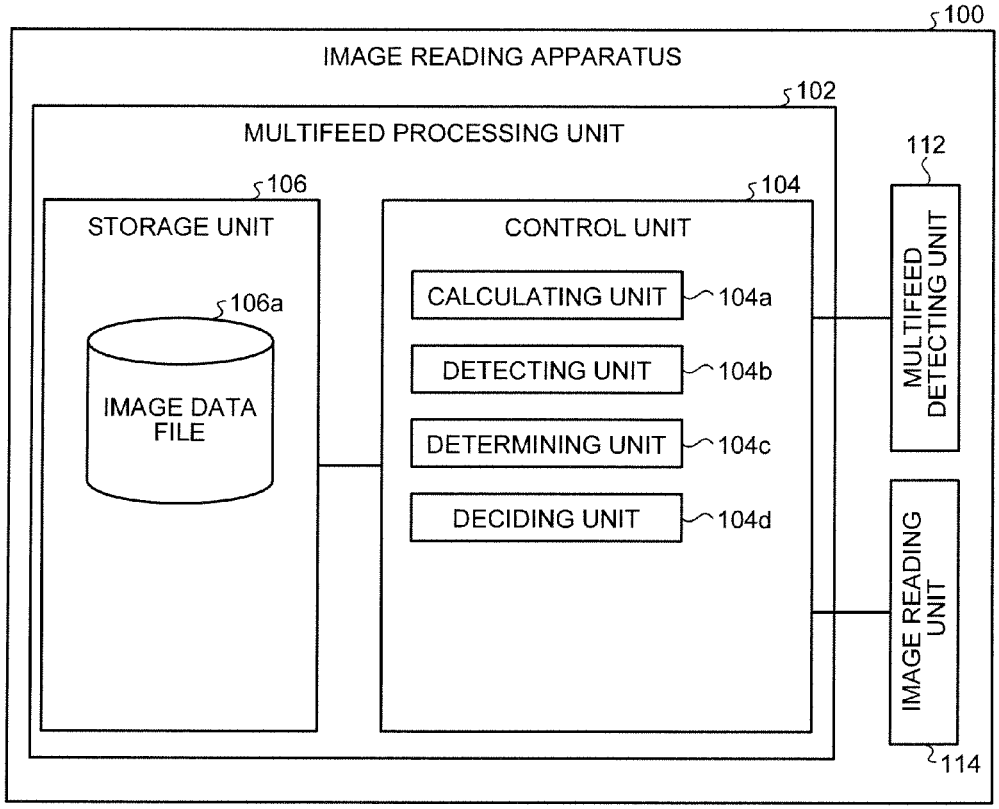
FIG. 7 is a diagram representing one example of a configuration of an image reading apparatus according to the present embodiment.

The multifeed processing unit 102, as shown in FIG. 7, includes a control unit 104 and a storage unit 106 in a functionally conceptual manner. The storage unit 106 stores therein various types of databases, tables, and files, or the like. The storage unit 106 is a storage unit, which can be a memory device such as RAM (Random Access Memory) and ROM (Read Only Memory), a fixed disk drive such as a hard disk, a flexible disk, and an optical disc, or the like. The storage unit 106, as shown in this figure, stores therein an image data file 106*a*. The image data file 106*a* stores therein image information for the paper read by the image reading unit 114.

The control unit 104 includes a CPU (Central Processing Unit) for controlling the image reading apparatus 100, and the like. The control unit 104 includes an internal memory for storing therein a control program such as OS (Operating System) and programs defining various processing procedures or the like and also storing therein required data, and performs information processes for executing various processes based on the programs. The control unit 104 includes a calculating unit 104*a*, a detecting unit 104*b*, a determining unit 104*c*, and a deciding unit 104*d* in a functionally conceptual manner.

The calculating unit 104*a* calculates a shape of a peripheral edge of a paper from an output of the image reading unit 114 and/or an image of the paper read by the image reading unit 114. Specifically, the calculating unit 104*a* calculates a skew of the paper from output information and image information or the like of the paper sensor in the image reading unit 114, and calculates a position of the peripheral edge of the paper from the image information by taking the calculated skew into consideration. In addition, the calculating unit 104*a* calculates a skew of the paper from output information and image information or the like of the paper sensor, and calculates a search (read) direction ("vertical direction" or "horizontal direction") of the image by taking the skew into consideration.

The detecting unit 104*b* detects a change in the shape on the boundary of an overlap detected portion from the shape of the peripheral edge calculated by the calculating unit 104*a* and the position of the overlap detected portion detected by the multifeed detecting unit 112. Specifically, the detecting unit 104*b* detects whether the shape of the peripheral edge of the paper calculated by the calculating unit 104*a* is a straight line.

The determining unit 104*c* determines whether a change similar to a change in the image of the overlap detected portion continues up to the peripheral edge, from a plurality of the images from the overlap detected portion to the peripheral edge of the paper read by the image reading unit 114. Specifically, the determining unit 104*c* performs a continuous-range detection process explained later on an image of the upper edge and an image of the lower edge of the overlap detected portion, detects a boundary of the upper edge and a continuity of an image change from the upper edge to the left and right peripheral edges of the paper, and detects a boundary of the lower edge and a continuity of an image change from the lower edge to the left and right peripheral edges of the paper. The determining unit 104*c* determines whether the change similar to the change in the image of the overlap detected portion continues up to the peripheral edges in the front and rear surfaces of the paper, respectively, from a plurality of the images on the front and rear surfaces of the paper from the overlap detected portion to the peripheral edges of the paper. In other words, the determining unit 104*c* determines a continuity of image change from the overlap detected portion to the peripheral edges of the paper in the front and rear surfaces of the paper, respectively.

The deciding unit 104*d*, when the change in the shape is detected by the detecting unit 104*b*, determines this case as "multifeed". When the change in the shape is not detected by the detecting unit 104*b*, the deciding unit 104*d* determines the detection by the multifeed detecting unit 112 as being caused by "attachment" of a photo, a slip, or the like. When two changes in the shape in the same direction are detected by the detecting unit 104*b*, the deciding unit 104*d* determines the detection by the multifeed detecting unit 112 as being caused by "sticky note" or the like attached to the paper.

In addition, when it is determined by the determining unit 104*c* that the change in the image continues, the deciding unit 104*d* determines this case as "multifeed". When it is determined by the determining unit 104*c* that the change in the image does not continue, the deciding unit 104*d* determines the detection by the multifeed detecting unit 112 as being caused by "attachment" of a photo, a slip, or the like. When it is determined by the determining unit 104*c* that two image changes continue in the same direction, the deciding unit 104*d* determines the detection by the multifeed detecting unit 112 as being caused by "sticky note" or the like attached to the paper.

2-2. Specific Example of Configuration

Next, a specific example of the configuration of the image reading apparatus 100 will be explained in detail with reference to FIG. 8 and FIG. 9. A specific configuration of the image reading apparatus which is a scanner is explained herein, however, the image reading apparatus is not limited to the scanner, and thus can be applied to a copier, a facsimile, and the like.

Figure 8:
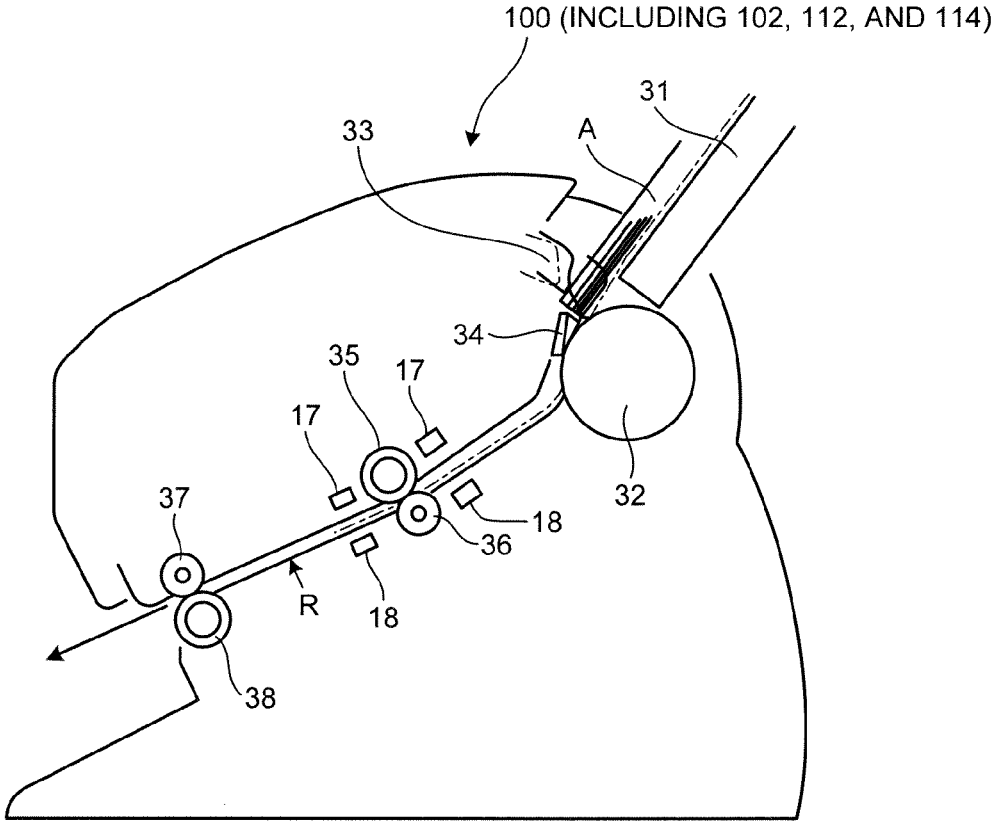
FIG. 8 is a schematic representing a configuration of a scanner being a specific example of the image reading apparatus according to the present embodiment.

FIG. 8 is a schematic representing an overview of a cross section of a scanner as the image reading apparatus 100 (hereinafter, sometimes described as "scanner 100"), and this figure shows an overview of the configuration of the scanner to which the multifeed processing unit 102, the multifeed detecting unit 112, and the image reading unit 114 are applied.

As shown in FIG. 8, the scanner 100 includes a paper mounting table (shooter) 31, a pick roller 32, a pick arm 33, a separation pad 34, feed rollers 35 and 36, and ejection rollers 37 and 38. The scanner 100 also includes a transmission-side ultrasonic sensor 17 and a reception-side ultrasonic sensor 18 of an ultrasonic detector, which is explained later, corresponding to the multifeed detecting unit 112. In FIG. 8, a dashed two-dotted line indicates a feed path of a paper A, and an arrow R indicates a reading position of the paper A.

Papers A placed on the paper mounting table (shooter) 31 are picked by the pick roller 32 in a state where the papers A are applied with an appropriate pressing force by the pick arm 33. At this time, the papers A are sequentially separated from their lower side sheet by sheet by the pick roller 32 and the separation pad 34. The picked paper A is further fed to the feed rollers 35 and 36 by the pick roller 32, is fed to a reading position by the feed rollers 35 and 36, is read by the image reading unit 114 at the reading position, and is ejected by the ejection rollers 37 and 38. During feeding of the paper A along the feed path, a plurality of sheets (usually two sheets) or multiply fed papers A which are not separated into one sheet each even by the separation pad 34 are detected by the transmission-side ultrasonic sensor 17 and the reception-side ultrasonic sensor 18. Therefore, as shown in FIG. 8, the transmission-side ultrasonic sensor 17 and the reception-side ultrasonic sensor 18 are disposed on the upstream side of the reading position where the paper is read by the image reading unit 114 in the feed path. Particularly, the sensors are disposed on the downstream side or the upstream side of the feed rollers 35 and 36.

Figure 9:
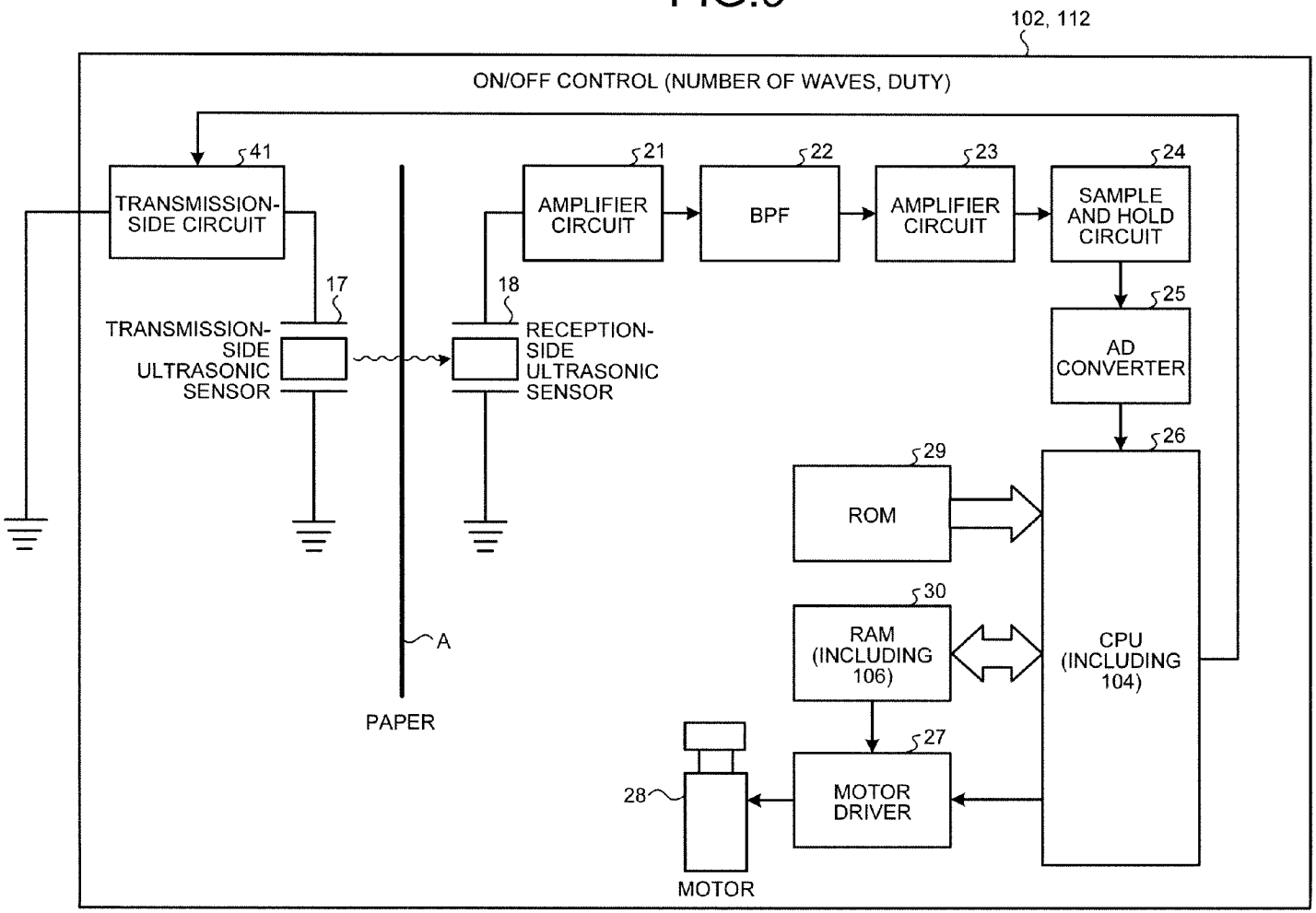
FIG. 9 is a diagram representing one example of a configuration of a multifeed processing unit and a multifeed detecting unit included in the scanner shown in FIG. 8.

FIG. 9 is a diagram representing one example of a specific configuration of the multifeed processing unit 102 and the multifeed detecting unit 112. In FIG. 9, the ultrasonic detector corresponding to the multifeed detecting unit 112 detects feeding of a plurality of papers A using ultrasonic waves. The ultrasonic detector includes the transmission-side ultrasonic sensor 17, a drive circuit thereof (transmission-side circuit, hereinafter the same) 41, the reception-side ultrasonic sensor 18, a setting unit (26) for setting a threshold used to detect feeding of a plurality of papers A (multifeed), and a detector (26) for detecting the feeding of the plurality of papers A.

The transmission-side ultrasonic sensor 17 emits an ultrasonic wave. The drive circuit 41 supplies a drive signal for driving the transmission-side ultrasonic sensor 17 thereto. The drive circuit 41 is configured with a circuit (which can ON/OFF control) that oscillates at a frequency near a resonant frequency of the transmission-side ultrasonic sensor 17. The reception-side ultrasonic sensor 18 is disposed so as to face the transmission-side ultrasonic sensor 17 across a paper feed path, and receives the ultrasonic wave. The setting unit sets a threshold used to detect the feeding of the plurality of papers A using an output of the reception-side ultrasonic sensor 18 as a reference value when an output of the transmission-side ultrasonic sensor 17 is stopped by the drive circuit 41. The detector compares the output of the reception-side ultrasonic sensor 18 with the threshold, and detects the feeding of the plurality of papers A.

The ultrasonic detector further includes an amplifier circuit 21 (at a first stage), a BPF (Band Pass Filter) 22, an amplifier circuit 23 (at a second stage), a sample and hold (S&H) circuit 24, an AD (Analog to Digital) converter 25, CPU 26, a motor driver 27, a motor 28, ROM 29, and RAM 30. These components constitute a reception-side circuit. More specifically, the reception-side ultrasonic sensor 18 outputs an electrical signal according to the ultrasonic wave received from the transmission-side ultrasonic sensor 17, the amplifier circuit 21 amplifies the electrical signal, the BPF removes noise therefrom, and, thereafter, the amplifier circuit 23 amplifies the signal after the noise is removed. Then, after the sample and hold circuit 24 samples and holds (SH) a peak value of the signal, the AD converter 25 converts the peak value (analog signal) into a digital value (digital signal). The AD converter 25 inputs the digital signal (input signal) to the CPU 26 (the setting unit and the detector therein), where it is analyzed. More specifically, the setting unit and the detector implemented by a setting and detection processing program (and hardware) on the CPU 26 analyze the input signal. The setting and detection processing program and the multifeed processing program are stored in, for example, the ROM 29 and/or the RAM 30. When a multifeed is detected, the CPU 26 (or the detector) transmits the drive signal to the motor driver 27, and causes the motor 28 to drive so as to stop feeding of (a plurality of) papers A. The CPU 26 includes processing units (the calculating unit 104*a* to the deciding unit 104*d*) of the control unit 104 in the multifeed processing unit 102 in addition to the setting unit and the detector in the multifeed detecting unit 112. The RAM 30 stores therein the image data file 106*a* of the storage unit 106 in the multifeed processing unit 102. When feeding of a plurality of papers is detected by the detector, information for the detection is input to the control unit 104 of the multifeed processing unit 102.

The ultrasonic detector includes the transmission-side circuit (drive circuit) 41. The transmission-side circuit 41 is configured from a drive IC, a resistance/frequency-controlled oscillator (OSC), and a variable resistor. The drive IC is a drive circuit for supplying a drive signal to drive the transmission-side ultrasonic sensor 17 thereto. This causes the transmission-side ultrasonic sensor 17 to emit an ultrasonic wave. The reception-side ultrasonic sensor 18 receives the ultrasonic wave, and outputs a detection signal according to the intensity of the received ultrasonic wave. For example, when the paper A is not present between the transmission-side ultrasonic sensor 17 and the reception-side ultrasonic sensor 18, the reception-side ultrasonic sensor 18 detects a signal with a certain level (ordinary level), and detects a signal with a level (normal level) less than the ordinary level but more than a predetermined threshold when a sheet of paper A is present. When two sheets (or more) of paper A are present, the reception-side ultrasonic sensor 18 detects a signal with a level (abnormal level) less than the ordinary level and the threshold. For example, before feeding of the paper A, the drive IC is controlled so that the reception-side ultrasonic sensor 18 detects the signal with the ordinary level (in actual cases, the signal with a level equal to or more than the ordinary level). More specifically, the drive IC is controlled so that the drive frequency of the drive signal coincides with the resonant frequency of the transmission-side ultrasonic sensor 17 based on the ultrasonic wave received by the reception-side ultrasonic sensor 18 without using the variable resistor.

The setting unit sets (generates) a threshold used to detect feeding of a plurality of papers A using an output of the reception-side ultrasonic sensor 18 as a reference value when an output of the transmission-side ultrasonic sensor 17 is stopped by the drive circuit 41. The threshold is determined by adding a fixed value (correction value) to the output (average value of input signals from the reception-side ultrasonic sensor 18) of the reception-side ultrasonic sensor 18 when an output of the transmission-side ultrasonic sensor 17 is stopped. More specifically, the CPU 26 (sensor control unit therein) transmits a control signal to the transmission-side circuit 41 and causes the oscillation of the transmission-side circuit 41 to stop. The CPU 26 (sensor control unit therein) applies a predetermined bias voltage to the amplifier circuit 23 (computation amplifier therein). In this state, the CPU 26 (generation unit therein) repeatedly receives the input signals, tens of times, for example, 32 times, from the reception-side ultrasonic sensor 18 through the AD converter 25, and calculates an average value thereof to set the value as a reference value. More specifically, the signals at 32 points within, for example, one raster are measured. The CPU 26 (generation unit therein) corrects to add the correction value to the reference value and generates the threshold, and stores the threshold in the CPU 26 (register therein). Here, the correction value is determined empirically for each device to be installed allowing for the influence of noise or the like. It should be noted that the correction value may be determined beforehand and that the correction value may be determined, each time it is required, as a variable value for each device for allowing for influence of variation in sensitivity/sound pressure of the ultrasonic sensor, variation in fixture, surroundings, and adhesion of paper dust or the like.

The detector compares the output of the reception-side ultrasonic sensor 18 with the threshold, and detects feeding of a plurality of papers A. The CPU 26 (sensor control unit therein) transmits a control signal to the transmission-side circuit 41 and the like to cause the transmission-side circuit 41 to oscillate. Moreover, the CPU 26 (sensor control unit therein) applies a predetermined bias voltage to the amplifier circuit 23 (computation amplifier therein). In this state, the CPU 26 (comparator therein) repeatedly receives the input signals (digital values), tens of times, for example, 32 times, from the reception-side ultrasonic sensor 18 through the AD converter 25, and holds the received signals. At this time, the oscillation (transmission-side drive pulses) of the transmission-side circuit 41 is stopped and the signals at a plurality of predetermined positions, for example, at 32 points are measured. The measuring position is set to once in, for example, each raster or once in a plurality of rasters. When an output waveform of the reception-side ultrasonic sensor 18 is getting larger to become a maximum value, the maximum value is sampled and held. Next, the CPU 26 (sensor control unit or comparator therein) sets a timer for SH interrupt, and determines whether an interrupt occurs. The SH interrupt is set so as to occur 32 times when, for example, 32 input signals are to be obtained as explained above. In other words, the SH interrupt triggers continuous outputs of drive pulses in the transmission side. For example, 32 times of SH interrupts occur in once in each raster with the passage of a predetermined time. When the interrupt does not occur, the determination of occurrence of the interrupt is repeated. When an interrupt occurs, an average value of 32 values previously received and held, for example, a moving average value is calculated, and this value is determined as a value of an input signal used to detect the multifeed (MF). Thereafter, the CPU 26 (comparator therein) compares the value of the input signal with the threshold of the register. When the value of the input signal is equal to or more than the threshold, the CPU 26 (comparator therein) determines that the result is normal paper feeding, while when the value of the input signal is less than the threshold, the CPU 26 (comparator therein) determines whether the number of times in this case is predetermined times, for example, ten times or more. When it is determined that the number of times is 10 times or more, the CPU 26 (comparator therein) determines that a multifeed occurs, and outputs an error signal. When it is determined that the number of times is not 10 times or more, the following processes performed after the timer is set are repeated. The error signal is then input to the control unit 104 of the multifeed processing unit 102 included in the CPU 26.

3. Process of Present Embodiment

Figure 10:
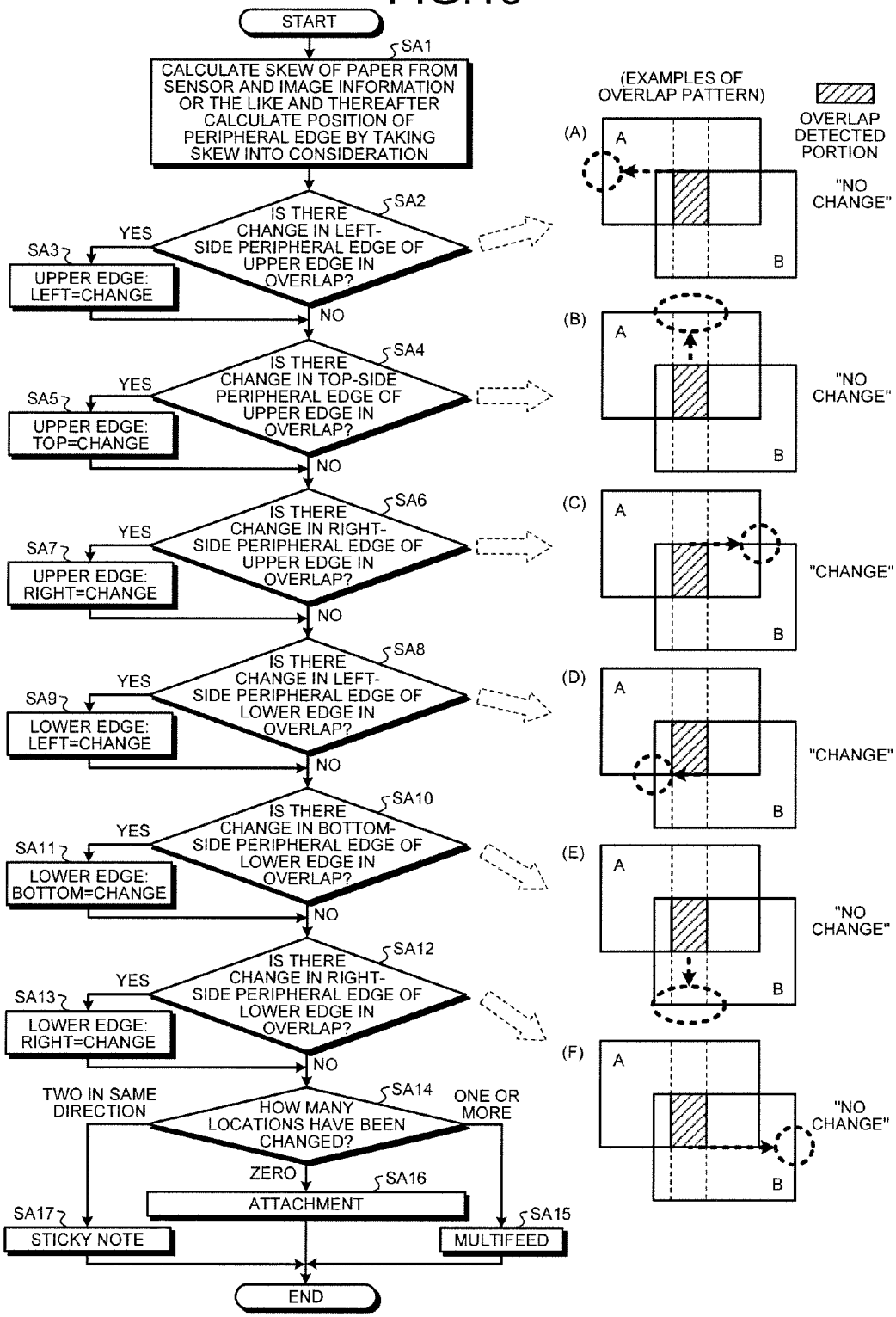
FIG. 10 is a flowchart representing one example of a main multifeed determination process of the present embodiment.
Figure 11:
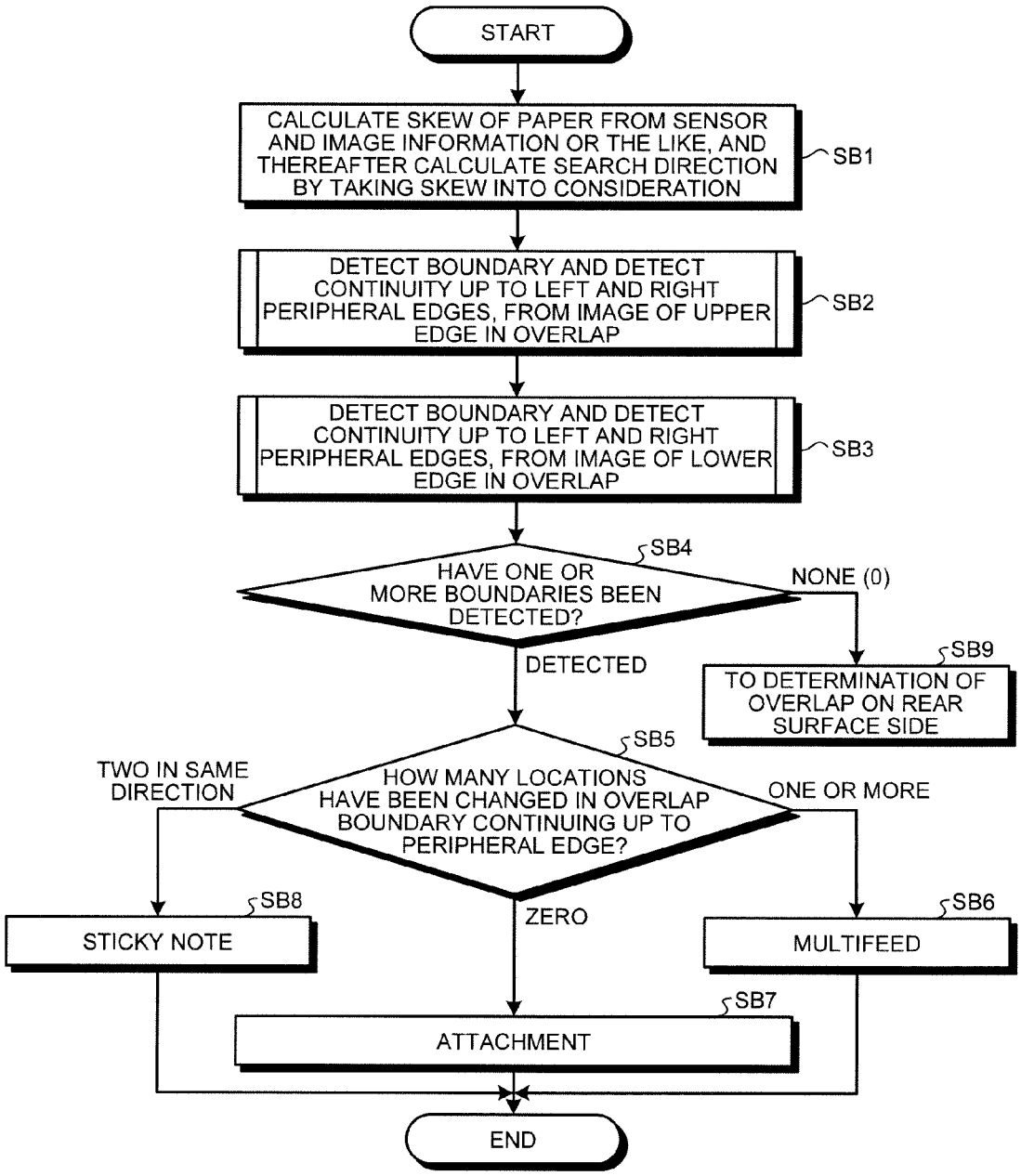
FIG. 11 is a flowchart representing one example of a secondary multifeed determination process of the present embodiment.

Here, one examples of various processes performed in the multifeed processing unit 102 of the image reading apparatus 100 configured in the above manner will be explained with reference to FIG. 10 to FIG. 12.

3-1. Main Multifeed Determination Process

First, one example of a main multifeed determination process performed in the multifeed processing unit 102 will be explained with reference to FIG. 10. FIG. 10 is a flowchart representing one example of the multifeed determination process.

First, the calculating unit 104*a* calculates a skew of the paper from output information and image information or the like of the paper sensor in the image reading unit 114, and calculates positions of the peripheral edges of the paper from the image information by taking the calculated skew into consideration (Step SA1). Specifically, by taking the skew into consideration, the calculating unit 104*a* calculates, from the image information, (i) a position of a left-side peripheral edge of the paper corresponding to the upper edge (left-side peripheral edge of the upper edge) of the overlap detected portion detected by the ultrasonic sensor of the multifeed detecting unit 112, (ii) a position of a top-side peripheral edge of the paper corresponding to the upper edge (top-side peripheral edge of the upper edge), (iii) a position of a right-side peripheral edge of the paper corresponding to the upper edge (right-side peripheral edge of the upper edge), (iv) a position of a left-side peripheral edge of the paper corresponding to the lower edge (left-side peripheral edge of the lower edge), (v) a position of a bottom-side peripheral edge of the paper corresponding to the lower edge (bottom-side peripheral edge of the lower edge), and (vi) a position of a right-side peripheral edge of the paper corresponding to the lower edge (right-side peripheral edge of the lower edge).

Next, the detecting unit 104*b* detects whether there is a change in the left-side peripheral edge of the paper corresponding to the upper edge calculated at Step SA1 from the image information. When it is detected that there is a change in the left-side peripheral edge of the upper edge (Yes at Step SA2), the detecting unit 104*b* substitutes a constant (e.g., numeral "1") indicating "change" into a prepared variable "upper edge: left" (Step SA3). In the example of an overlap pattern shown in (A) of FIG. 10, the shape of the left-side peripheral edge of the upper edge in a specific range (range indicated by dotted circle) is a straight line, and thus it is detected that there is no change in the left-side peripheral edge of the upper edge.

Next, the detecting unit 104*b* detects whether there is a change in the top-side peripheral edge of the paper corresponding to the upper edge calculated at Step SA1 from the image information. When it is detected that there is a change in the top-side peripheral edge of the upper edge (Yes at Step SA4), the detecting unit 104*b* substitutes the constant indicating "change" into a prepared variable "upper edge: top" (Step SA5). In the example of an overlap pattern shown in (B) of FIG. 10, the shape of the top-side peripheral edge of the upper edge in a specific range (range indicated by dotted circle) is a straight line, and thus it is detected that there is no change in the top-side peripheral edge of the upper edge.

Next, the detecting unit 104*b* detects whether there is a change in the right-side peripheral edge of the paper corresponding to the upper edge calculated at Step SA1 from the image information. When it is detected that there is a change in the right-side peripheral edge of the upper edge (Yes at Step SA6), the detecting unit 104*b* substitutes the constant indicating "change" into a prepared variable "upper edge: right" (Step SA7). In the example of an overlap pattern shown in (C) of FIG. 10, the shape of the right-side peripheral edge of the upper edge in a specific range (range indicated by dotted circle) is not a straight line, and thus it is detected that there is a change in the right-side peripheral edge of the upper edge. The constant indicating "change" is then substituted into the variable "upper edge: right".

Next, the detecting unit 104*b* detects whether there is a change in the left-side peripheral edge of the paper corresponding to the lower edge calculated at Step SA1 from the image information. When it is detected that there is a change in the left-side peripheral edge of the lower edge (Yes at Step SA8), the detecting unit 104*b* substitutes the constant indicating "change" into a prepared variable "lower edge: left" (Step SA9). In the example of an overlap pattern shown in (D) of FIG. 10, the shape of the left-side peripheral edge of the lower edge in a specific range (range indicated by dotted circle) is not a straight line, and thus it is detected that there is a change in the left-side peripheral edge of the lower edge. The constant indicating "change" is then substituted into the variable "lower edge: left".

Next, the detecting unit 104*b* detects whether there is a change in the bottom-side peripheral edge of the paper corresponding to the lower edge calculated at Step SA1 from the image information. When it is detected that there is a change in the bottom-side peripheral edge of the lower edge (Yes at Step SA10), the detecting unit 104*b* substitutes the constant indicating "change" into a prepared variable "lower edge: bottom" (Step SA11). In the example of an overlap pattern shown in (E) of FIG. 10, the shape of the bottom-side peripheral edge of the lower edge in a specific range (range indicated by dotted circle) is a straight line, and thus it is detected that there is no change in the bottom-side peripheral edge of the lower edge.

Next, the detecting unit 104*b* detects whether there is a change in the right-side peripheral edge of the paper corresponding to the lower edge calculated at Step SA1 from the image information. When it is detected that there is a change in the right-side peripheral edge of the lower edge (Yes at Step SA12), the detecting unit 104*b* substitutes the constant indicating "change" into a prepared variable "lower edge: right" (Step SA13). In the example of an overlap pattern shown in (F) of FIG. 10, the shape of the right-side peripheral edge of the lower edge in a specific range (range indicated by dotted circle) is a straight line, and thus it is detected that there is no change in the right-side peripheral edge of the lower edge.

When the constant indicating "change" is substituted into one or more of the prepared variables "upper edge: left", "upper edge: top", "upper edge: right", "lower edge: left", "lower edge: bottom", and "lower edge: right" (Step SA14: one or more), then the deciding unit 104*d* determines this case as "multifeed" (Step SA15). When there is no constant indicating "change" (Step SA14: zero), then the deciding unit 104*d* determines this case as "attachment" of a photo, a slip, or the like (Step SA16). When the constant indicating "change" is substituted into two variables in the same direction such as "upper edge: left" and "lower edge: left", or "upper edge: right" and "lower edge: right" (Step SA14: two in the same direction), then the deciding unit 104*d* determines this case as "sticky note" (Step SA17). It should be noted that the constant indicating "change" is substituted into the variable "upper edge: right" in the example of the overlap pattern shown in (C) of FIG. 10 and the constant indicating "change" is substituted into the variable "lower edge: left" in the example of the overlap pattern shown in (D) of FIG. 10, and thus the example of the overlap pattern shown in FIG. 10 is determined as "multifeed".

3-2. Secondary Multifeed Determination Process

Next, a secondary multifeed determination process continuously performed when the deciding unit 104*d* determines a case as "attachment" in the main multifeed determination process will be explained with reference to FIG. 11 and the like. FIG. 11 is a flowchart representing one example of the secondary multifeed determination process continuously performed when it is determined as "attachment".

First, the calculating unit 104*a* calculates a skew of the paper from output information and image information or the like of the paper sensor, and calculates a search (read) direction ("vertical direction" or "horizontal direction") of the image by taking the skew into consideration (Step SB1). In the following explanation, a case where the calculated search direction is "horizontal direction" is adopted as one example.

Figure 12:
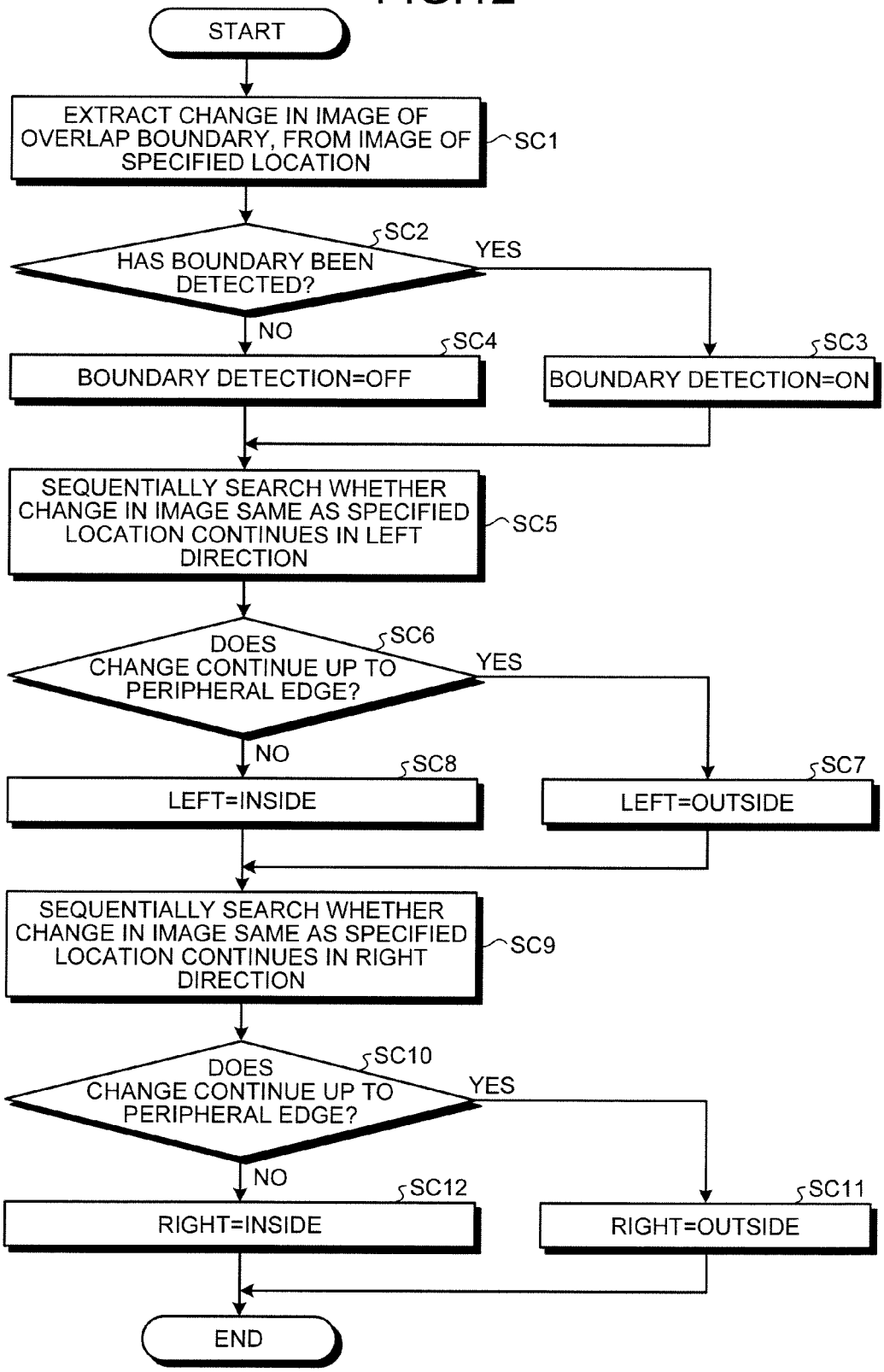
FIG. 12 is a flowchart representing one example of a continuous-range detection process of the present embodiment.

Next, the determining unit 104*c* performs a continuous-range detection process shown in FIG. 12 on the image of the upper edge in the overlap detected portion, to perform boundary detection of the upper edge and continuity detection of a change in the image from the upper edge to the left and right peripheral edges of the paper (Step SB2).

Next, the determining unit 104*c* performs the continuous-range detection process shown in FIG. 12 on the image of the lower edge of the overlap detected portion, to perform boundary detection of the lower edge and continuity detection of a change in the image from the lower edge to the left and right peripheral edges of the paper (Step SB3).

Here, the continuous-range detection process performed at Step SB2 and Step SB3 will be explained with reference to FIG. 12. FIG. 12 is a flowchart representing one example of the continuous-range detection process.

First, the determining unit 104*c* extracts (detects) an image change of an overlap boundary of papers by detecting a change in color due to different types of papers and by detecting a shade of the paper from the image at a specified location of the overlap detected portion (specifically, the image of "upper edge" of the overlap detected portion when the present process is performed at Step SB2 and the image of "lower edge" of the overlap detected portion when the present process is performed at Step SB3) (Step SC1).

Next, when the image change of the boundary can be detected at Step SC1 (Yes at Step SC2), the determining unit 104*c* substitutes a constant indicating "ON" (e.g., numeral "1") into a prepared variable "specified location: boundary detection" (Step SC3). When the image change of the boundary cannot be detected at Step SC1 (No at Step SC2), the determining unit 104*c* substitutes a constant indicating "OFF" (e.g., numeral "0") into the variable "specified location: boundary detection" (Step SC4). When the present process is performed at Step SB2, the constant indicating "ON" or "OFF" is substituted into a prepared variable "upper edge: boundary detection", while when the present process is performed at Step SB3, the constant indicating "ON" or "OFF" is substituted into a prepared variable "lower edge: boundary detection".

Next, the determining unit 104*c* sequentially reads images in the left direction (search direction calculated at Step SB1) of the image at the specified location from the image data file 106*a*, extracts whether there is an image change which is the same as the image change at the specified location from each of the read images, and searches whether the image change the same as the image change at the specified location in the sequentially read images continues up to the left-side peripheral edge of the paper (Step SC5).

Next, when it is searched at Step SC5 that the image change continues up to the peripheral edge (Yes at Step SC6), the determining unit 104*c* substitutes a constant indicating "outside" (e.g., numeral "1") into a prepared variable "specified location: left", and stores that the image change the same as the image change at the specified location continues up to the left-side peripheral edge of the paper (Step SC7). When it is searched at Step SC5 that the image change does not continue up to the peripheral edge (No at Step SC6), the determining unit 104*c* substitutes a constant indicating "inside" (e.g., numeral "0") into the variable "specified location: left", and stores that the image change the same as the image change at the specified location does not continue up to the left-side peripheral edge of the paper (Step SC8). When the present process is performed at Step SB2, the constant indicating "outside" or "inside" is substituted into a prepared variable "upper edge: left", while when the present process is performed at Step SB3, the constant indicating "outside" or "inside" is substituted into a prepared variable "lower edge: left".

Next, the determining unit 104*c* sequentially reads images in the right direction (search direction calculated at Step SB1) of the image at the specified location from the image data file 106*a*, extracts whether there is an image change the same as the image change at the specified location from each of the read images, and searches whether the image change the same as the image change at the specified location in the sequentially read images continues up to the right-side peripheral edge of the paper (Step SC9).

Next, when it is searched at Step SC9 that the image change continues up to the peripheral edge (Yes at Step SC10), the determining unit 104*c* substitutes the constant indicating "outside" into a prepared variable "specified location: right", and stores that the image change the same as the image change at the specified location continues up to the right-side peripheral edge of the paper (Step SC11). When it is searched at Step SC9 that the image change does not continue up to the peripheral edge (No at Step SC10), the determining unit 104*c* substitutes the constant indicating "inside" into the variable "specified location: right", and stores that the image change the same as the image change at the specified location does not continue up to the right-side peripheral edge of the paper (Step SC12). When the present process is performed at Step SB2, the constant indicating "outside" or "inside" is substituted into a prepared variable "upper edge: right", while when the present process is performed at Step SB3, the constant indicating "outside" or "inside" is substituted into a prepared variable "lower edge: right".

This ends the explanation of the continuous-range detection process shown in FIG. 12. At the time of ending the execution of Step SB2 and Step SB3, the constant indicating "ON" or "OFF" has been substituted into the variables "upper edge: boundary detection" and "lower edge: boundary detection", and the constant indicating "outside" or "inside" has been substituted into the variables "upper edge: left", "upper edge: right", "lower edge: left", and "lower edge: right".

Referring back to FIG. 11, when one or more boundaries have been detected at Step SB2 and Step SB3 (specifically, when the constant indicating "ON" is substituted into at least one of the variables "upper edge: boundary detection" and "lower edge: boundary detection") (Step SB4: detected) and when there is one or more of image-change locations in the overlap boundary which continues up to the peripheral edge of the paper (Step SB5: one or more), then the deciding unit 104*d* determines this case as "multifeed" (Step SB6). When there is no change (Step SB5: zero), then the deciding unit 104*d* determines this case as "attachment" of a photo, a slip, or the like (Step SB7). When there are two changes in the same direction (Step SB5: two in the same direction), then the deciding unit 104*d* determines this case as "sticky note" (Step SB8). Specifically, when the constant indicating "outside" is substituted into one or more of the variables "upper edge: left", "upper edge: right", "lower edge: left", and "lower edge: right", then this case is determined as "multifeed", and when no constant is substituted, then this case is determined as "attachment". In addition, when the constant indicating "outside" is substituted into two variables in the same direction such as "upper edge: left" and "lower edge: left", or "upper edge: right" and "lower edge: right", then this case is determined as "sticky note".

When there is not more than one boundary detection at Step SB2 and Step SB3 (specifically, when the constant indicating "OFF" is substituted into both of the variables "upper edge: boundary detection" and "lower edge: boundary detection") (Step SB4: None (0)), the control unit 104 causes the processing units to perform overlap determination on the rear surface side of the paper in the above manner (Step SB9).

4. Summary of Present Embodiment and Other Embodiments

As mentioned above, according to the present embodiment, "multifeed" and "attachment" of a paper or the like are discriminated from each other, from the left, right, upper, or lower edge of the overlap detected portion and from the shape of the peripheral edge of the paper (Solution 1). Specifically, when the shapes of the peripheral edges of the paper change on the boundaries of the overlap detected portion, this case is determined as "multifeed", from the left, right, upper, and lower edges of the overlap detected portion detected by the ultrasonic sensor and from the shape of the overall paper obtained from the paper sensor and the image information. When the shapes of the peripheral edges of the paper do not change, this case is determined as "attachment" of a paper or the like. More specifically, the skew of the paper is calculated from the sensor information and the image information or the like, and a peripheral edge of the paper located at the left side of the upper edge of the overlap detected portion is found out by taking the calculated skew into consideration. When the shape of the peripheral edge near the found-out peripheral edge is not a straight line, this case is determined as "multifeed". Likewise, when any one of the shapes of a peripheral edge of the paper located at the top side of the upper edge of the overlap detected portion and of a peripheral edge of the paper located at the right side thereof is not a straight line, this case is determined as "multifeed". Furthermore, when any one of the shapes of a peripheral edge of the paper located at the left side of the lower edge of the overlap detected portion, of a peripheral edge of the paper located at the bottom side thereof, and of a peripheral edge of the paper located at the right side thereof is not a straight line, then this case is determined as "multifeed". This allows automatic discrimination of the multifeed from the attachment without preset of a size and an area by which multifeed is disabled, thus largely improving the operability.

In addition, according to the present embodiment, images of the paper at a detection starting position and a detection ending position of the overlap detected portion are analyzed, an overlap range is detected from continuity of the images, and it is determined whether this case is "multifeed" (Solution 2). Specifically, the images at the detection starting position and the detection ending position of the overlap detected portion are analyzed. Generally, a change in color due to different types of papers and a shade of the overlapping paper are detected from images, and thus in a case of an overlap, the change or the shade continues up to a wide range. The overlap range is detected from continuity of the images, and when the range continues up to the peripheral edge of the paper, this case is determined as "multifeed". More specifically, the skew of the paper is calculated from the sensor information and the image information or the like, and a change in an image of the upper edge of the overlap detected portion is extracted. Generally, a change in color due to different types of papers and a shade of the overlapping paper are detected. Images are sequentially read in the left direction from the upper edge of the overlap detected portion by taking the skew into consideration, how far in the left direction the image change which is the same as that of the upper edge continues is extracted, and it is determined whether the image change continues up to the left-side peripheral edge of the paper. Likewise, images are sequentially read in the right direction from the upper edge of the overlap detected portion, how far in the right direction the image change which is the same as that of the upper edge continues is extracted, and it is determined whether the image change continues up to the right-side peripheral edge of the paper. Furthermore, images are sequentially read in the left direction and the right direction from the lower edge of the overlap detected portion in the above manner, how far in the left direction and the right direction the image change which is the same as that of the lower edge continues is extracted, and it is determined whether the image change continues up to the left-side peripheral edge of the paper and the right-side peripheral edge thereof, respectively. The "multifeed" is determined from the position where the change continues up to the peripheral edge of the paper and from the number of changes. This allows automatic discrimination of the multifeed from the attachment without preset of the size and the area by which multifeed is disabled, thus largely improving the operability. Moreover, even if the multifeed cannot be detected by the solution 1, the multifeed can be more accurately detected using the solution 2. In addition, by combining results of determinations of the front surface and the rear surface, it is possible to perform multifeed detection with higher accuracy.

Moreover, the present invention may be implemented in various different embodiments in the scope of technical idea described in the appended claims other than the embodiment. For example, of the processes explained in the embodiment, all or part of the processes explained as automatically performed ones can be manually performed, or all or part of the processes explained as manually performed ones can be also automatically performed using known methods. A specific configuration of distribution or integration of the apparatuses is not limited to the illustrated one. The apparatuses can be configured by functionally or physically distributing or integrating all or part of the apparatuses in arbitrary units according to various types of additions or the like or according to functional loads. In addition, the process procedures, the control procedures, the specific names, and the screen examples shown in the present specification and the drawings can be arbitrarily modified unless otherwise specified.

The constituent elements of the image reading apparatus 100 shown in the drawings are functionally conceptual, and need not be physically configured as illustrated. For example, for the process functions provided in the image reading apparatus 100, especially for the process functions performed in the control unit 104, all or part thereof may be implemented by a CPU and programs interpreted and executed in the CPU, and may be implemented as hardware by wired logic. The programs are recorded in a recording medium, explained later, and they are mechanically loaded into the image reading apparatus 100 as required. More specifically, computer programs to perform various processes are recorded in the storage unit 106 such as ROM or an HD (Hard Disk). The computer programs are executed by being loaded into RAM, and form the control unit in cooperation with the CPU.

The multifeed processing apparatus according to the present invention may be configured as an information processing apparatus (including an information processing apparatus connected with arbitrary peripheral devices) such as known personal computers and work stations. The multifeed processing apparatus according to the present invention may be achieved by installing software (including the programs, the data, and the like) to implement the multifeed processing method according to the present invention. The multifeed processing program according to the present invention may be stored in a computer-readable recording medium, or can be configured as a program product. Here, the "recording medium" mentioned here includes any "portable physical medium" such as a flexible disk, a magneto-optical disc, ROM, EPROM (Erasable Programmable Read Only Memory), EEPROM (Electronically Erasable and Programmable Read Only Memory), CD-ROM (Compact Disk Read Only Memory), MO (Magneto-Optical disk), and a DVD (Digital Versatile Disk) or includes a "communication medium" that temporarily holds a program, such as a communication line and a carrier used to transmit the program through a network such as LAN (Local Area Network), WAN (Wide Area Network), and the Internet. The "program" mentioned here is a data processing method described in arbitrary language and description method, and thus any form such as a source code and a binary code is acceptable. It should be noted that the "program" is not necessarily limited to a program configured as a single unit, and, therefore, includes those distributedly configured as a plurality of modules and libraries and those in which the function of the program is achieved in cooperation with separate programs represented as OS. Regarding a specific configuration and a reading procedure to read a recording medium by the apparatuses shown in the embodiments, or an installation procedure after the reading, or the like, known configuration and procedures can be used.

According to the present invention, (i) a shape of a peripheral edge of a medium (specifically, a skew of the medium and a position of the peripheral edge which is determined by taking the skew into consideration) is calculated from any one or both of an output of the image reading mechanism and an image of the medium read by the image reading mechanism, (ii) a change in the shape (specifically, whether the shape of the peripheral edge of the medium is a straight line) is detected on a boundary of an overlap detected portion from the calculated shape and a position of the overlap detected portion detected by the multifeed detecting mechanism, and (iii) a case where the change in the shape is detected (specifically, the shape of the peripheral edge of the medium is not a straight line), is determined as a multifeed. Thus, there is such an effect that the multifeed can be accurately detected without causing the user to carry out the troublesome operations.

According to the present invention, when the change in the shape is not detected (specifically, the shape of the peripheral edge of the medium is a straight line), it is determined that the detection by the multifeed detecting mechanism is caused by a paper-like matter (specifically, a photo, a slip, or the like attached to a paper) with the medium which is read by the image reading mechanism in a state in which the entire paper-like matter fits inside the medium. Thus, there is such an effect that the attachment of a paper such as a photo, a slip, or the like attached within the paper can be discriminated from the multifeed.

According to the present invention, when the change in the shape is detected in two portions in a same direction (specifically, two portions in which the shape of the peripheral edge is not a straight line are present in the left-side, top-side, right-side, or bottom-side peripheral edge of the medium), it is determined that the detection by the multifeed detecting mechanism is caused by a paper piece (specifically, a sticky note or the like attached to a paper) with the medium which is read by the image reading mechanism in a state in which a part of the paper piece protrudes outside the medium. Thus, there is such an effect that the attachment of a paper such as a sticky note attached to near the peripheral edge of the paper can be discriminated from the multifeed.

According to the present invention, when the change in the shape is not detected, it is determined whether a change similar to the change in the image of the overlap detected portion continues up to the peripheral edge of the medium, from a plurality of the images from the overlap detected portion to the peripheral edge of the medium, and a case where it is determined that the change in the image continues, is determined as the multifeed. Thus, there is such an effect that the multifeed can be more accurately detected. Specifically, there is such an effect that a multifeed in which widths of the papers (left and right positions of the papers) coincide with each other can be accurately detected.

According to the present invention, when it is determined that the change in the image does not continue, it is determined that the detection by the multifeed detecting mechanism is caused by a paper-like matter (specifically, a photo, a slip, or the like attached to a paper) with the medium which is read by the image reading mechanism in a state in which the entire paper-like matter fits inside the medium. Thus, there is such an effect that the attachment of a paper such as a photo, a slip, or the like attached within the paper can be accurately discriminated from the multifeed.

According to the present invention, when it is determined that the change in the image continues in two portions in a same direction, it is determined that the detection by the multifeed detecting mechanism is caused by a paper piece (specifically, a sticky note or the like attached to a paper) with the medium which is read by the image reading mechanism in a state in which a part of the paper piece protrudes outside the medium. Thus, there is such an effect that the attachment of a paper such as a sticky note attached to near the peripheral edge of the paper can be accurately discriminated from the multifeed.

According to the present invention, it is determined whether a change similar to the change in the image of the overlap detected portion continues up to the peripheral edge in each of a front surface and a rear surface of the medium, from a plurality of the images on the front surface and the rear surface of the medium from the overlap detected portion to the peripheral edge of the medium. Thus, there is such an effect that the multifeed can be more accurately detected.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A multifeed processing apparatus comprising a control unit and being connected to a multifeed detecting mechanism and an image reading mechanism, wherein the control unit includes a calculating unit that calculates a shape of a peripheral edge of a medium from any one or both of an output of the image reading mechanism and an image of the medium read by the image reading mechanism, a detecting unit that detects a change in the shape on a boundary of an overlap detected portion, from the shape calculated by the calculating unit and a position of the overlap detected portion detected by the multifeed detecting mechanism, a determining unit that, when the change in the shape is not detected by the detecting unit, determines whether a change similar to the change in the image of the overlap detected portion continues up to the peripheral edge of the medium, from a plurality of the images from the overlap detected portion to the peripheral edge of the medium, and a deciding unit that determines a case where the change in the shape is detected by the detecting unit, as a multifeed, and determines a case where the determining unit determines that the change in the image continues, as a multifeed.

2. The multifeed processing apparatus according to claim 1, wherein the deciding unit, when the change in the shape is not detected by the detecting unit, determines that the detection by the multifeed detecting mechanism is caused by a paper-like matter with the medium which is read by the image reading mechanism in a state in which the entire paper-like matter fits inside the medium.

3. The multifeed processing apparatus according to claim 1, wherein the deciding unit, when the change in the shape is detected by the detecting unit in two portions in a same direction, determines that the detection by the multifeed detecting mechanism is caused by a paper piece with the medium which is read by the image reading mechanism in a state in which a part of the paper piece protrudes outside the medium.

4. The multifeed processing apparatus according to claim 1, wherein the deciding unit, when the determining unit determines that the change in the image does not continue, determines that the detection by the multifeed detecting mechanism is caused by a paper-like matter with the medium which is read by the image reading mechanism in a state in which the entire paper-like matter fits inside the medium.

5. The multifeed processing apparatus according to claim 1, wherein the deciding unit, when the determining unit determines that the change in the image continues in two portions in a same direction, determines that the detection by the multifeed detecting mechanism is caused by a paper piece with the medium which is read by the image reading mechanism in a state in which a part of the paper piece protrudes outside the medium.

6. The multifeed processing apparatus according to claim 1, wherein the determining unit determines whether a change similar to the change in the image of the overlap detected portion continues up to the peripheral edge in each of a front surface and a rear surface of the medium, from a plurality of the images on the front surface and the rear surface of the medium from the overlap detected portion to the peripheral edge of the medium.

7. A non-transitory tangible computer-readable medium having instructions for a control unit of a multifeed processing apparatus connected to a multifeed detecting mechanism and an image reading mechanism, the instructions, when executed, causing the control unit to perform:

a calculating step of calculating a shape of a peripheral edge of a medium from any one or both of an output of the image reading mechanism and an image of the medium read by the image reading mechanism;

a detecting step of detecting a change in the shape on a boundary of an overlap detected portion, from the shape calculated at the calculating step and a position of the overlap detected portion detected by the multifeed detecting mechanism;

a determining step of, when the change in the shape is not detected at the detecting step, determining whether a change similar to the change in the image of the overlap detected portion continues up to the peripheral edge of the medium, from a plurality of the images from the overlap detected portion to the peripheral edge of the medium; and a deciding step of determining a case where the change in the shape is detected at the detecting step, as a multifeed, and determining a case where the determining step determines that the change in the image continues, as a multifeed.

8. A multifeed processing apparatus connected to a multifeed detecting mechanism and an image reading mechanism, the multifeed processing apparatus comprising a control unit, wherein:

the control unit includes a calculating unit that calculates a shape of a peripheral edge of a medium from any one or both of an output of the image reading mechanism and an image of the medium read by the image reading mechanism;

a detecting unit that detects a change in the shape on a boundary of an overlap detected portion, from the shape calculated by the calculating unit and a position of the overlap detected portion detected by the multifeed detecting mechanism; and a deciding unit that determines a case where the change in the shape is detected by the detecting unit, as a multifeed, and the deciding unit, when the change in the shape is detected by the detecting unit in two portions in a same direction, determines that the detection by the multifeed detecting mechanism is caused by a paper piece with the medium which is read by the image reading mechanism in a state in which a part of the paper piece protrudes outside the medium.

9. A non-transitory tangible computer-readable medium having instructions for a control unit of a multifeed processing apparatus connected to a multifeed detecting mechanism and an image reading mechanism, the instructions, when executed, causing the control unit to perform:

a calculating step of calculating a shape of a peripheral edge of a medium from any one or both of an output of the image reading mechanism and an image of the medium read by the image reading mechanism;

a detecting step of detecting a change in the shape on a boundary of an overlap detected portion, from the shape calculated at the calculating step and a position of the overlap detected portion detected by the multifeed detecting mechanism; and a deciding step of determining a case where the change in the shape is detected at the detecting step, as a multifeed, wherein at the deciding step, when the change in the shape is detected at the detecting step in two portions in a same direction, it is determined that the detection by the multifeed detecting mechanism is caused by a paper piece with the medium which is read by the image reading mechanism in a state in which a part of the paper piece protrudes outside the medium.

* * * * *